US006409689B1

(12) United States Patent
Chen

(10) Patent No.: US 6,409,689 B1
(45) Date of Patent: Jun. 25, 2002

(54) FOLDABLE MASSAGING MATTRESS

(76) Inventor: Peter Chen, Room 4C-23, No. 5, Sec. 5, Sinyi Rd., Taipei (TW)

( * ) Notice: Subject to any disclaimer, the term of this patent is extended or adjusted under 35 U.S.C. 154(b) by 6 days.

(21) Appl. No.: 09/694,601

(22) Filed: Oct. 23, 2000

(51) Int. Cl.[7] ..... A61H 15/00
(52) U.S. Cl. ..... 601/99; 601/97; 601/98; 601/103
(58) Field of Search ..... 601/97–103, 87, 601/90, 93, 94, 115–116

(56) References Cited

U.S. PATENT DOCUMENTS 4,458,675 A * 7/1984 Nakao et al. ..... 128/52
4,656,998 A * 4/1987 Masuda et al. ..... 128/57
4,947,833 A * 8/1990 Yamasaki ..... 128/52
5,385,531 A * 1/1995 Jover ..... 601/99
6,071,252 A * 6/2000 Marcantoni ..... 601/115

* cited by examiner

*Primary Examiner*—Justine R. Yu
(74) *Attorney, Agent, or Firm*—Alan Kamrath; Rider, Bennett, Egan & Arundel, LLP

(57) ABSTRACT

A foldable massaging mattress is disclosed. The massaging mattress includes a mattress body having a protruding pillow portion at an end thereof and a track having a first end and a second end. The track is arranged in the mattress body and extends in the longitudinal midway of the mattress body. The track has at least two sections pivotally connected with each other. A gear case is arranged in the protruding pillow portion of the mattress body in a location adjacent to the first end of the track. A sprocket case is arranged in the mattress body in a location adjacent to the second end of the track. A DC motor is included for driving the gear case. A carriage has opposed two ends and is movable along the track. A chain runs between the gear and sprocket cases and has two ends attached to the opposed two ends of the carriage. The chain is driven by the gear case.

12 Claims, 8 Drawing Sheets

FOLDABLE MASSAGING MATTRESS

BACKGROUND OF THE INVENTION

1. Field of the Invention

The present invention relates to a massaging mattress and, more particularly to a foldable massaging mattress which can massage a user lying thereon at fill length.

2. Description of Related Art

A massaging mattress that can massage a user lying thereon at full length is known. The massaging mattress typically has a full-scale frame arranged therein. Because of the stiffness of the frame, such a mattress is not foldable for storage or carrying.

A massaging mattress that has two halves pivotally connected to one another is also known. This massager is foldable but can not massage a user lying thereon at full length, since it has a massaging mechanism arranged only in one of the halves thereof.

Therefore, it is an objective of the invention to provide a foldable massaging mattress to mitigate and/or obviate the aforementioned problems.

SUMMARY OF THE INVENTION

The object of the present invention is to provide a foldable massaging mattress which can massage a user lying thereon at full length.

Other objects, advantages and novel features of the invention will become more apparent from the following detailed description when taken in conjunction with the accompanying drawings.

DETAILED DESCRIPTION OF THE PREFERRED EMBODIMENT

Figure 1:
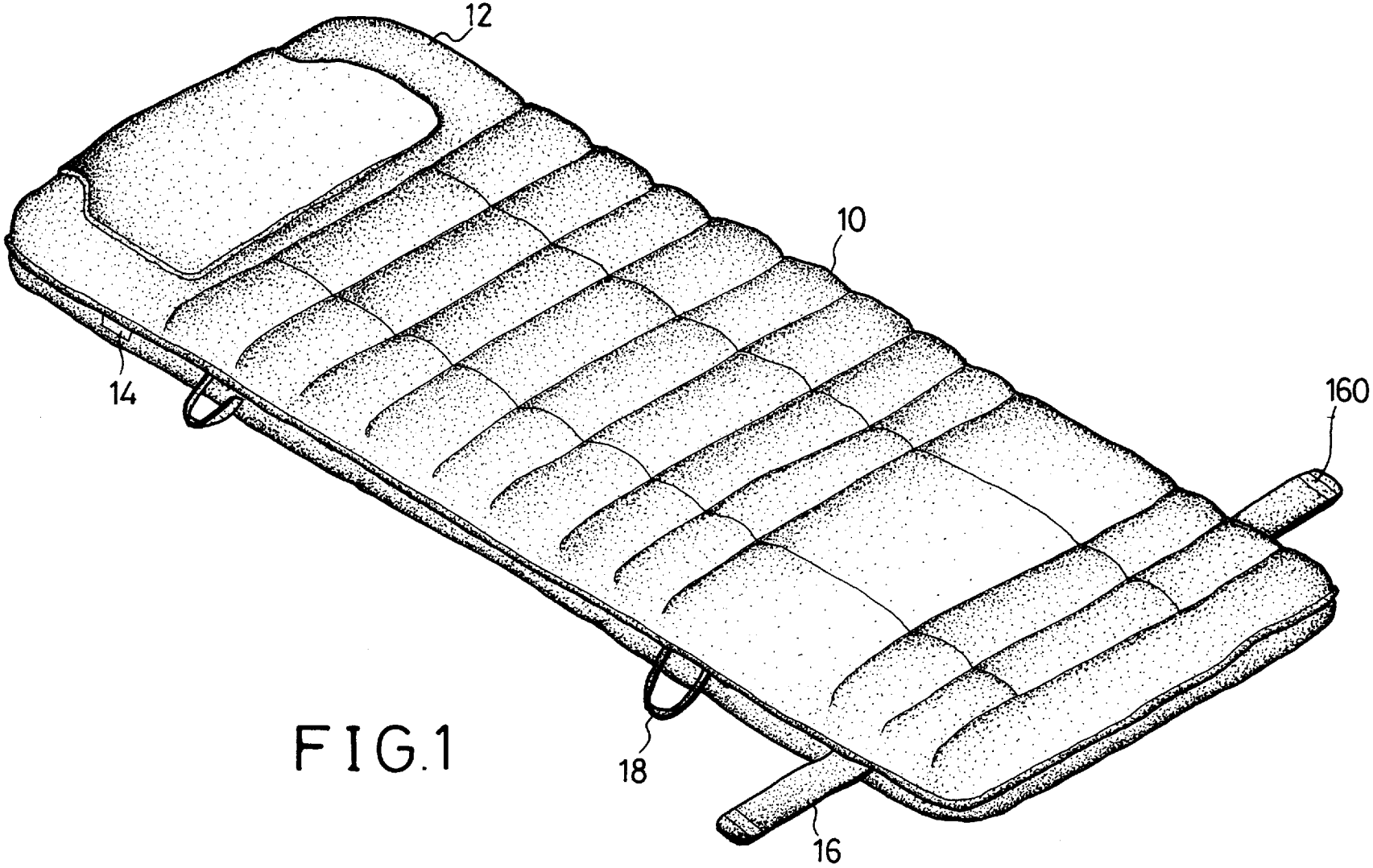
FIG. 1 is a perspective view showing a foldable massaging mattress in accordance with the present invention in an unfolded position.

Referring to FIG. 1, a foldable massaging mattress constructed in accordance with the present invention includes a mattress body (10).

The mattress body (10) preferably has a protruding pillow portion (12) at a first end thereof, a pair of first adhesive tapes (14) formed on opposed sides thereof and in locations near the first end, and a pair of straps (16) extending from the opposed sides in locations near a second end thereof The straps (16) are formed with respective second adhesive tapes (160) attachable to the first tapes (14). The mattress body (10) further has a pair of handles (18) formed thereon for the convenience of lifting or carrying the body (10).

Figure 2:
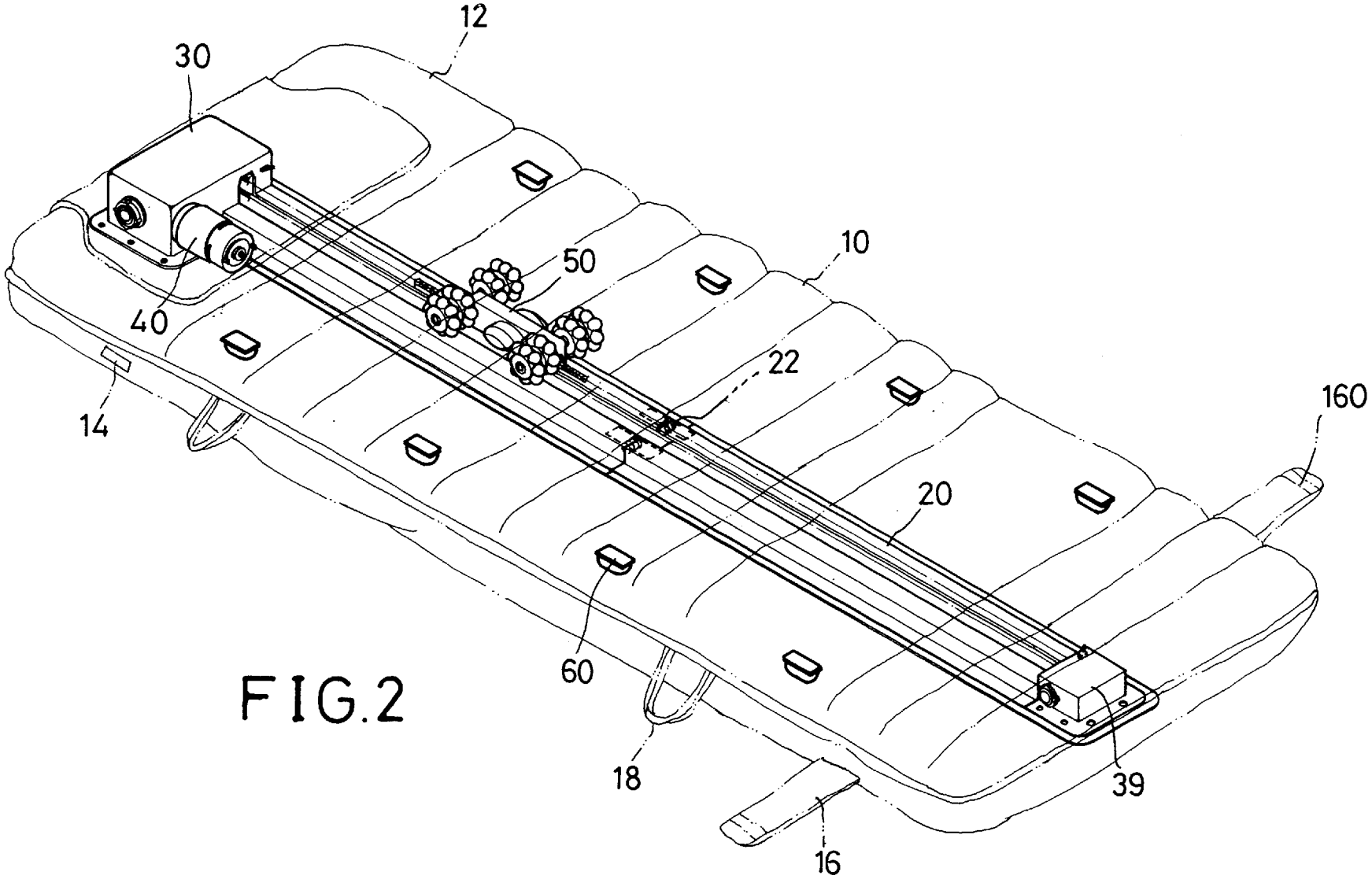
FIG. 2 is a perspective view showing a mechanism arranged in the massaging mattress of FIG. 1.

Referring to FIG. 2, arranged in the mattress body (10) is a track (20) that extends in the longitudinal midway of the mattress body (10).

The track (20) has a first end and a second end. A gear case (30) is arranged in the protruding pillow portion (12) of the mattress body (10) in a location adjacent to the first end of the track (20), while a sprocket case (39) is arranged in the mattress body (10) in a location adjacent to the second end of the track (20). The gear case (30) is driven by a DC motor (40) located nearby. Additionally, a carriage (50) is movable along the track (20) between the cases (30, 39).

Figure 3:
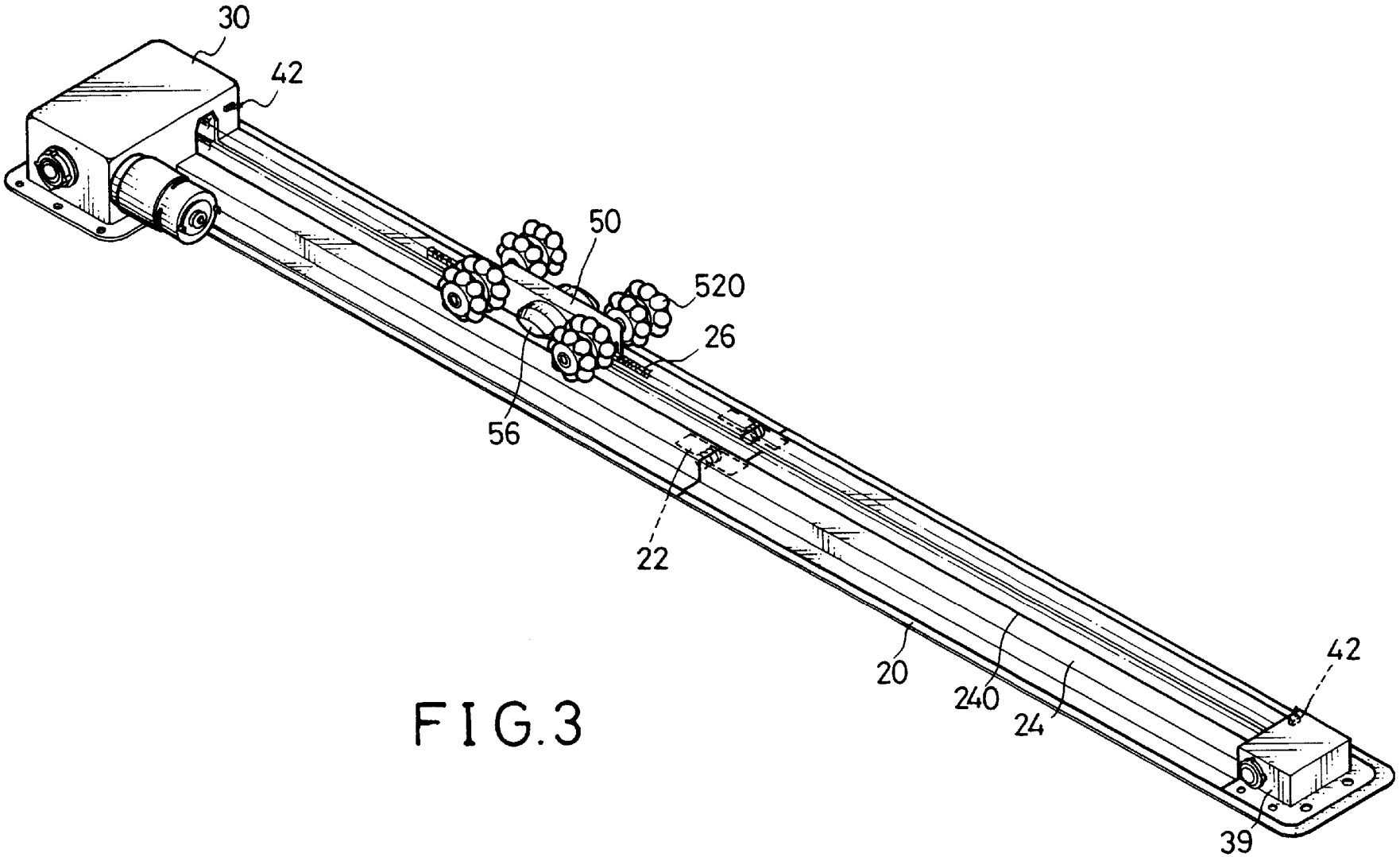
FIG. 3 is an enlarged perspective view of the mechanism shown in FIG. 2.

Referring to FIG. 3, the track (20) consists of two sections that are pivotally connected with each other at a joint (22) situated substantially in the midpoint thereof. The track (20) defines therein a pair of longitudinal chambers (24) and a longitudinal slot (240) intervening between the longitudinal chambers (24).

The carriage (50) has a first end and a second end, and is moved along the track (20) by a chain (26) that is received in the longitudinal slot (240) of the track (20) and runs between the cases (30, 39). The chain (26) is driven by the gear case (30) that is further driven by the DC motor (40).

The motor (40) must be controlled in such a way that the carriage (50) may be reciprocated along the track (20), such as by means of two limit switches (42) that are formed on the cases (30, 39) for alternately reversing the rotation of the motor (40) when being switched over by the reciprocating carriage (50).

Figure 4:
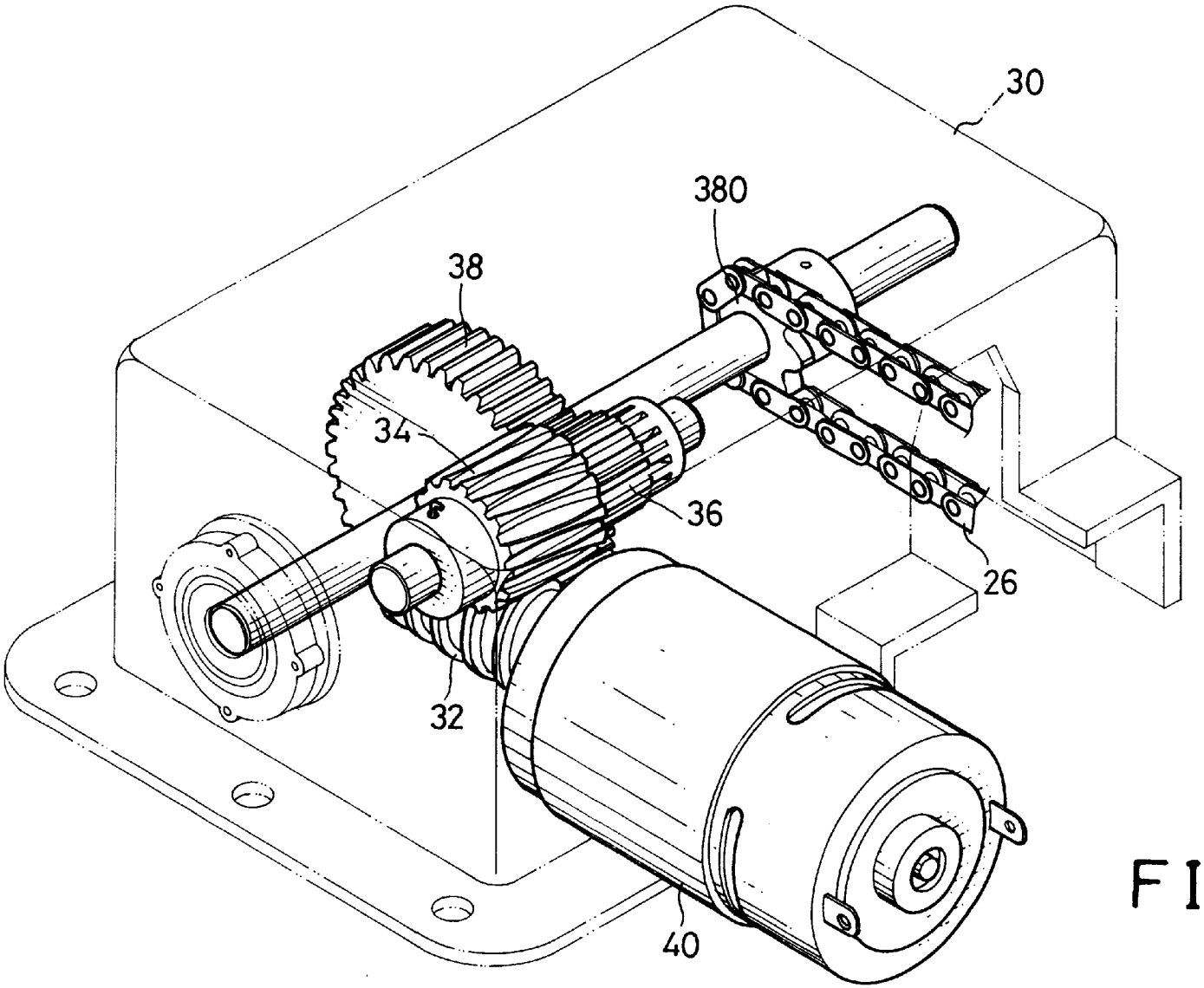
FIG. 4 is a perspective view of a gear case and a DC motor involved in the mechanism of FIG. 3.

Referring to FIG. 4, the gear case (30) has a worm (32) driven by the DC motor (40), a worm gear (34) engaged with the worm (32), a pinion (36) rotatable with the worm (32), a wheel gear (38) engaged with the pinion (36), and a first sprocket (380) rotatable with the wheel gear (38).

The chain (26) has a first end and a second end, and is engaged around the first sprocket (380) and a second sprocket (not shown) rotatably disposed in the sprocket case (39). In this manner, the chain (26) runs to and fro as the DC motor (40) turns clockwise and counterclockwise alternately.

Figure 5:
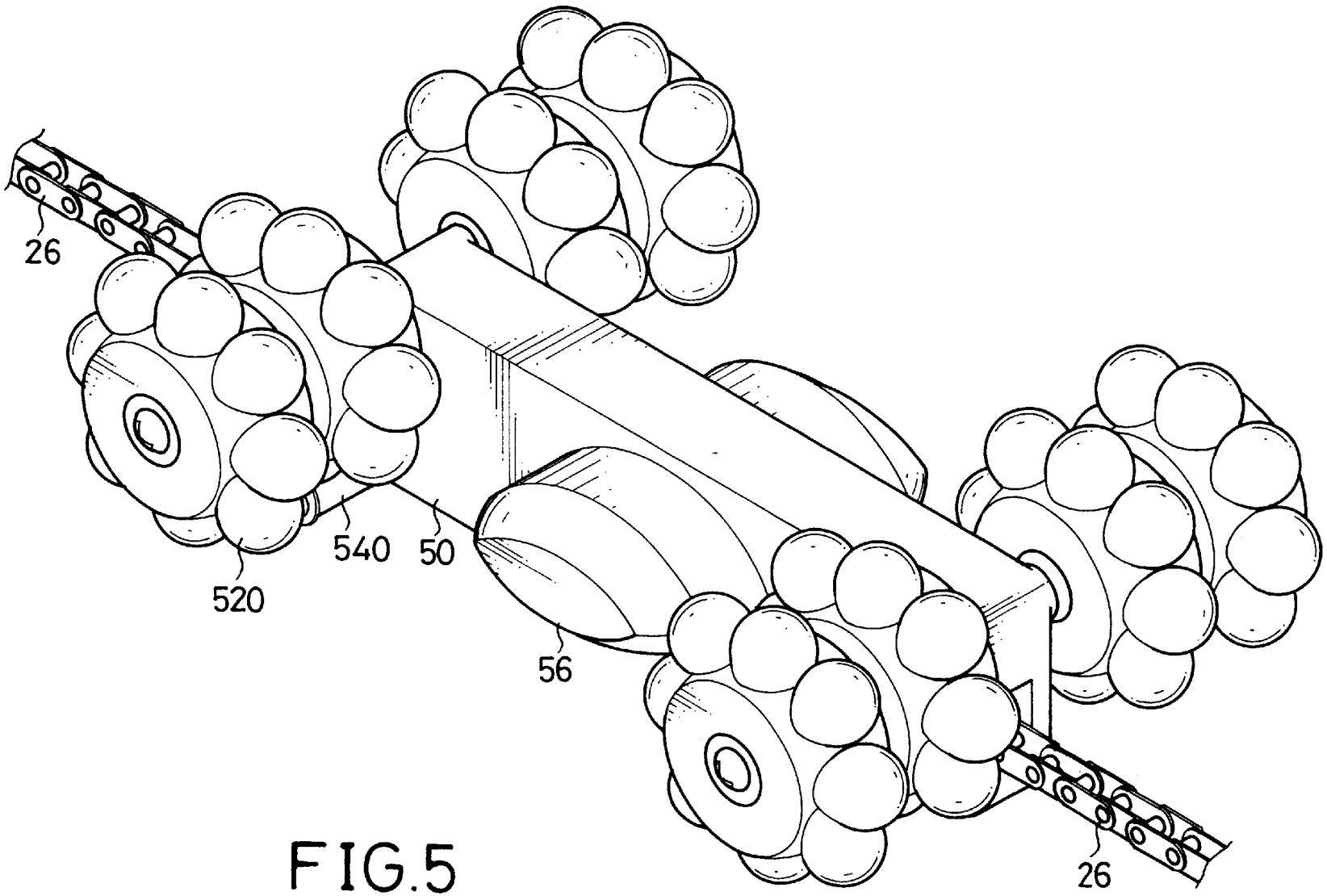
FIG. 5 is a perspective view of a carriage involved in the mechanism of FIG. 3.

Referring to FIG. 5, the carriage (50) has two pairs of massaging wheels (520) rotatable at opposed sides thereof, and a compartment (56) for containing a primary vibration motor (not shown) to drive the massaging wheels (520). Each massaging wheel (520) comprises two halves.

Figure 6:
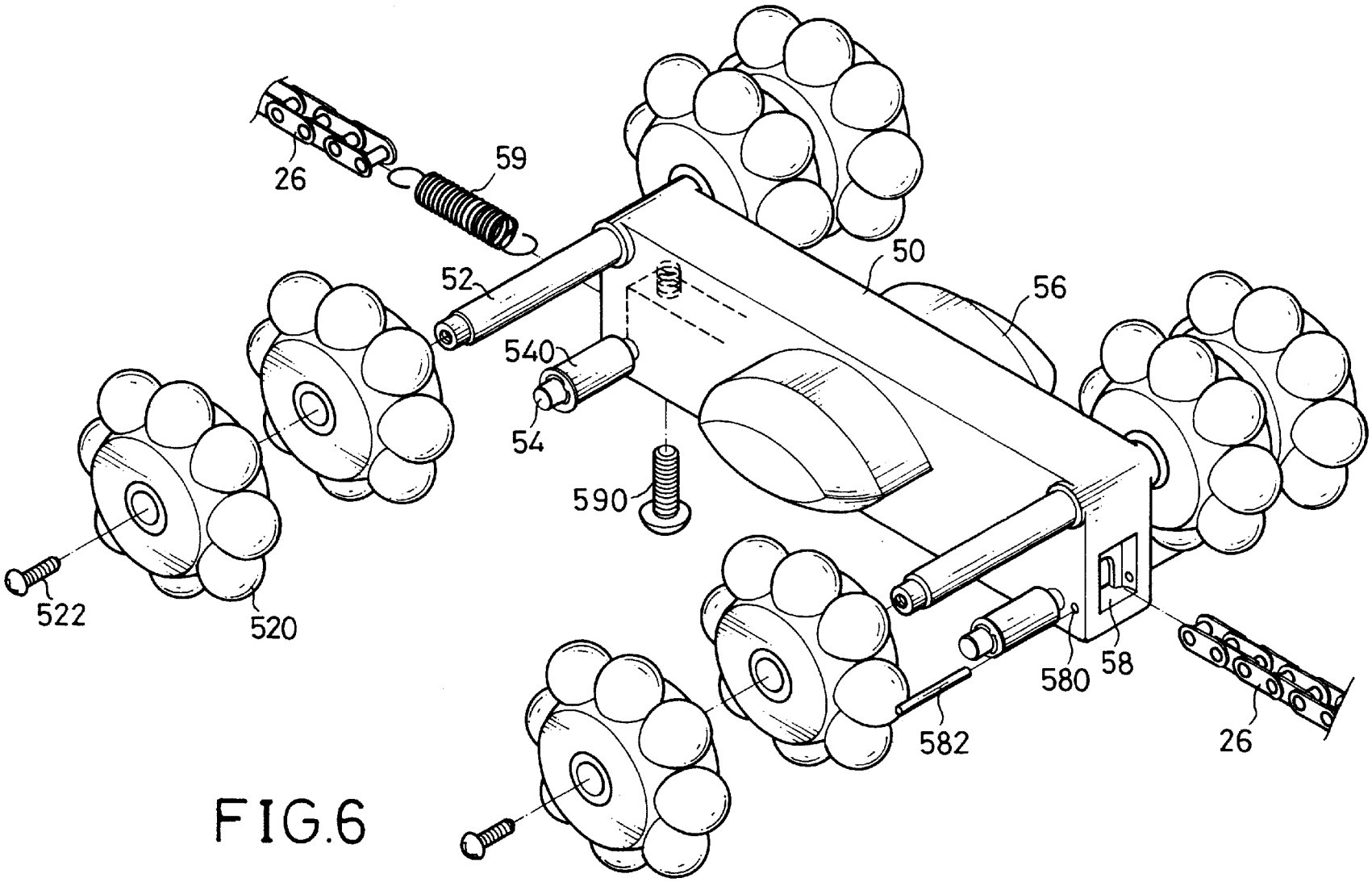
FIG. 6 is an exploded view of the carriage shown in FIG. 5.

Referring to FIG. 6, two pairs of shafts (52) transversely and oppositely extend from the carriage (50). The shafts (52), rotatable relative to the carriage (50), are driven by the primary vibration motor, and the massaging wheels (520) are mounted around and secured to respective shafts (52), preferably by screws (522).

Preferably, the carriage (50) has two pairs of roller pins (54) (only one pair of them is shown) transversely and oppositely extending therefrom, with two pairs of annular rollers (540) respectively and rotatably mounted around the pins (54). The annular rollers (540) are arranged to be rolled along the track (20) within the longitudinal chambers (24), as best shown in FIG. 3, thereby providing a smooth movement for the carriage (50).

At the second end of the carriage (50), there are defined an opening (58) and a pinhole (580) in communication with the opening (58). The opening (58) is provided for receiving the first end of the chain (26) which is pivotally connected to this end of the carriage (50) by a pintle (582) extending through the pinhole (580) and the first end of the chain (26).

At the first end of the carriage (50), there is a spring (59) that has a first end attached thereto through a screw (590), and a second end attached to the second end of the chain (26).

In the illustrated embodiment, the mattress of the present invention also includes a plurality of secondary vibration motors (60) formed on a face thereof, as shown in FIG. 2.

The foldable massaging mattress of the present invention is operated by actuating the DC motor (40), which will cause the chain (26) to run to and fro, and hence the carriage (50), to be reciprocated along the track (20). Simultaneously, the massaging wheels (520) are driven to be rotated by the primary vibration motor, thereby providing a massage for a user lying on the mattress at a fill length of the track (20). At the same time, the secondary vibration motors (60) will provide an additional massage for the same user to enhance the effect given by the inventive mattress.

Figure 7:
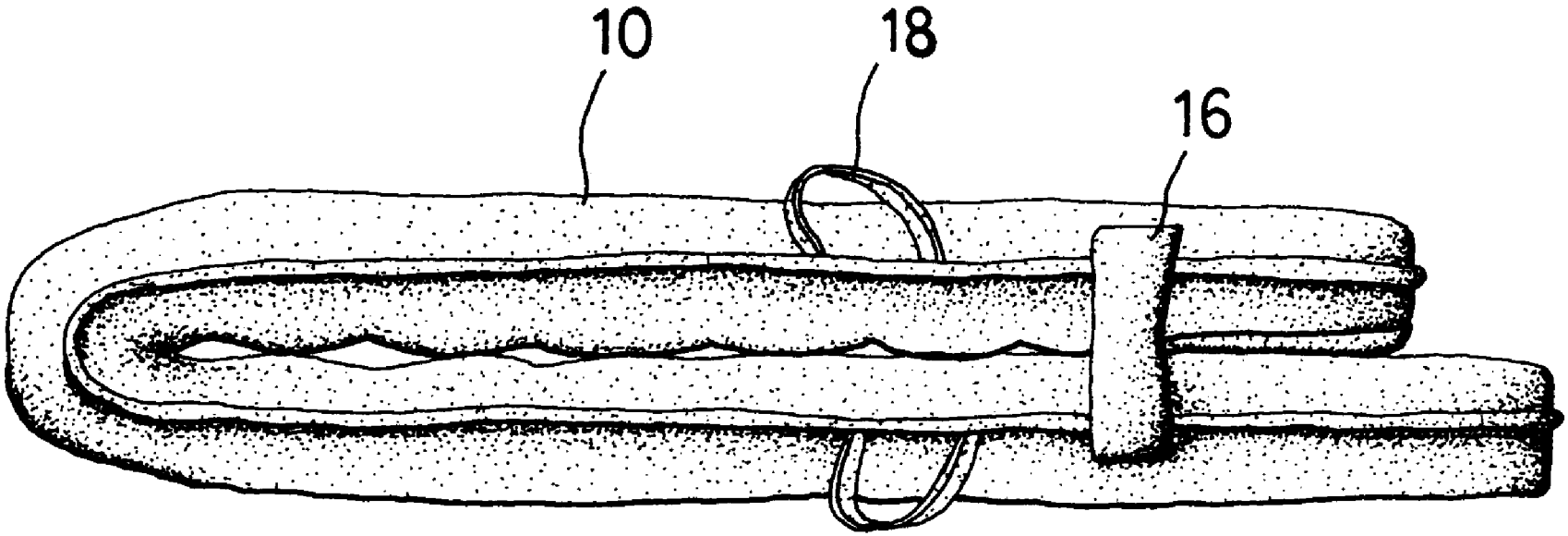
FIG. 7 is a side view showing the massaging mattress of FIG. 1 in a folded position.
Figure 8:
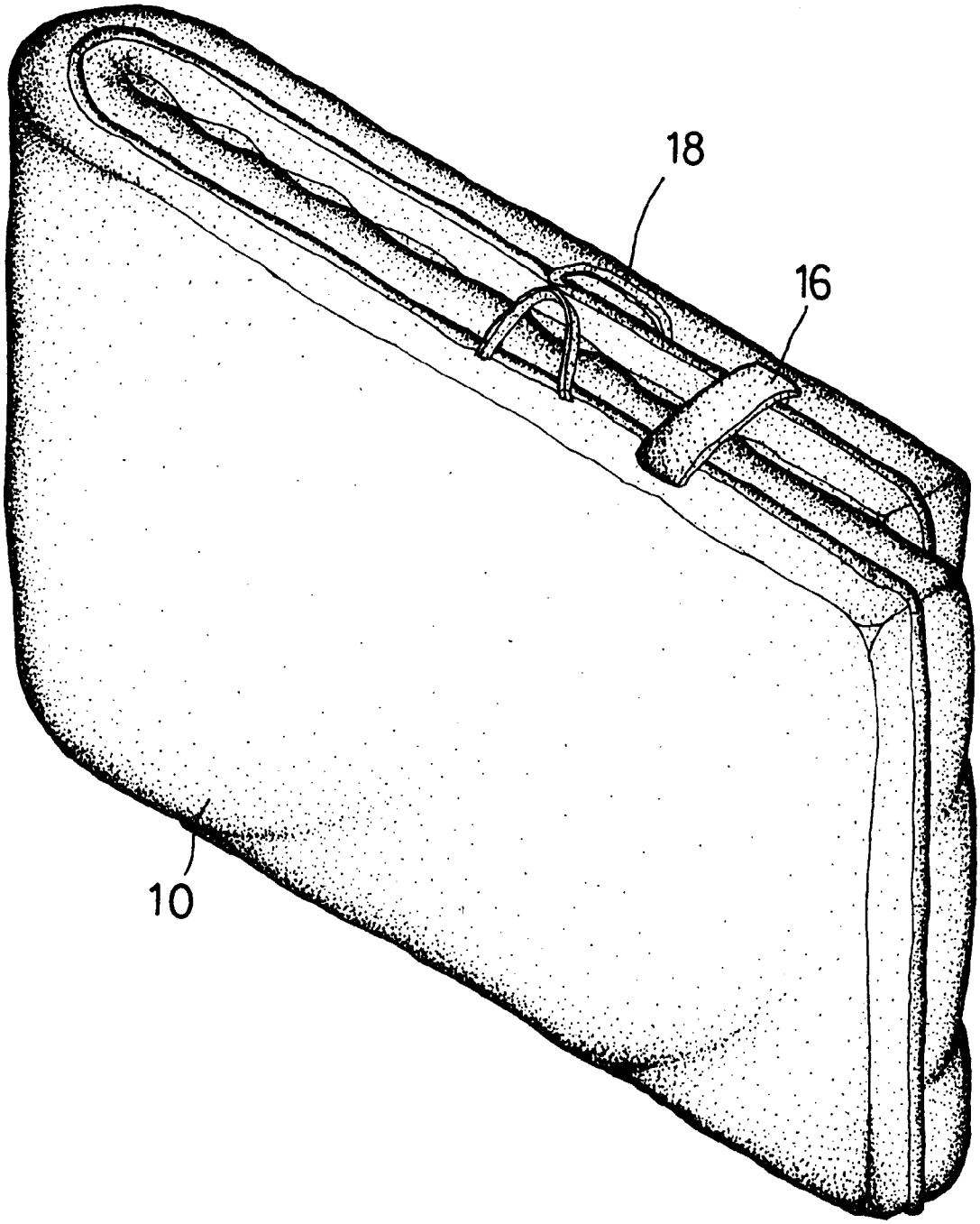
FIG. 8 is a perspective view showing the massaging mattress of FIG. 1 in the folded position.

Due to the single track (20) that consists of two sections pivotally connected at the joint (22), the massaging mattress of the present invention can be folded up and kept in this configuration by the straps (16) with the tapes (160) of the straps (16) attached to the respective tapes (14), as shown in FIGS. 7 and 8, for the purpose of storage or carrying.

From the above description, it is noted that the invention has the advantage of being foldable and able to massage the user lying thereon at full length.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A foldable massaging mattress comprising:

a mattress body (10) having a first end and a second end, and a protruding pillow portion (12) at said first end thereof;

a track (20) having a first end and a second end, said track (20) being arranged in said mattress body (10) and extending in the longitudinal midway of said mattress body (10), said track (20) having at least two sections pivotally connected with each other;

a gear case (30) arranged in said protruding pillow portion (12) of said mattress body (10) in a location adjacent to said first end of said track (20);

a sprocket case (39) arranged in said mattress body (10) in a location adjacent to said second end of said track (20);

a DC motor (40) for driving said gear case (30);

a carriage (50) having first and second opposed ends and movable along said track (20); and a chain (26) running between said gear and sprocket cases (30, 39) and having two ends respectively attached to said opposed two ends of said carriage (50), said chain (26) being driven by said gear case (30).

2. The foldable massaging mattress as claimed in claim 1, wherein said track (20) has a pair of longitudinal chambers (24) defined therein and a longitudinal slot (240) intervening between said longitudinal chambers (24).

3. The foldable massaging mattress as claimed in claim 1, wherein said gear and sprocket cases (30, 39) have respective limit switches (42) formed thereon for alternately reversing the rotation of said DC motor (40) when said switches (42) are switched over by said carriage (50).

4. The foldable massaging mattress as claimed in claim 1, wherein said gear case (30) has a worm (32) driven by said DC motor (40), a worm gear (34) engaged with said worm (32), a pinion (36) rotatable with said worm (32), a wheel gear (38) engaged with said pinion (36), and a first sprocket (380) rotatable with said wheel gear (38) and engaged with said chain (26).

5. The foldable massaging mattress as claimed in claim 1, wherein said carriage (50) has two pairs of shafts (52) transversely and oppositely extending therefrom, said shafts (52) are rotatable relative to the carriage (50) and are driven by said DC motor, (40), wherein two pairs of massaging wheels (520) are respectively mounted around and secured to said shafts (52).

6. The foldable massaging mattress as claimed in claim 5, wherein said carriage (50) further has two pairs of roller pins (54) transversely and oppositely extending therefrom, and two pair of annular rollers (540) respectively and rotatably mounted around said roller pins (54).

7. The improved mattress as claimed in claim 1, wherein said carriage (50) includes an opening (58) formed at said second end thereof, a pinhole (580) in communication with said opening (58), and a pintle (582) extending through said pinhole (580) and one of said ends of said chain (26).

8. The improved mattress as claimed in claim 1, wherein said carriage (50) includes a spring (59) having a first end attached to said first end of said carriage (50) and a second end attached to the other end of said chain (26).

9. The foldable massaging mattress as claimed in claim 1, wherein said mattress body (10) has a pair of first tapes (14) formed on opposed sides in locations near said first end thereof and a pair of straps (16) extending from said opposed sides in locations near said second end thereof, wherein said straps (16) are formed with respective second tapes (160) attachable to said first tapes (14).

10. The foldable massaging mattress as claimed in claim 1, wherein said mattress body (10) has a pair of handles (18) formed thereon.

11. The foldable massaging mattress as claimed in claim 1, wherein said track (20) has a length over one half of the whole length of said mattress body (10).

12. The foldable massaging mattress as claimed in claim 1, wherein said mattress body (10) has a plurality of secondary vibration motors (60) formed on a face thereof.

* * * * *